United States Patent [19]

Owen et al.

[11] 4,116,205

[45] Sep. 26, 1978

[54] FOLDABLE HAIR BRUSH

[75] Inventors: Ronald C. Owen, Harwood Heights; John C. Curry, Westchester, both of Ill.

[73] Assignee: Plastisonics Company, Inc., Chicago, Ill.

[21] Appl. No.: 752,592

[22] Filed: Dec. 20, 1976

[51] Int. Cl.[2] ..... A45D 44/18

[52] U.S. Cl. ..... 132/85

[58] Field of Search ..... 132/85, 121, 143; 15/140.4, 258, 159, 185, 187

[56] References Cited

U.S. PATENT DOCUMENTS

| | | | |
|---|---|---|---|
| 2,196,812 | 4/1940 | Kreutzig | 132/85 |
| 2,657,412 | 11/1953 | Carlson | 15/185 |
| 2,850,753 | 9/1958 | Pelletier | 15/185 |
| 3,739,419 | 6/1973 | Natman | 15/187 |
| 3,967,338 | 7/1976 | Russell | 15/185 |

*Primary Examiner*—Louis G. Mancene
*Attorney, Agent, or Firm*—Bernard L. Kleinke

[57] ABSTRACT

A foldable hair brush includes a hollow elongated handle having an elongated opening therein for receiving a brush portion hingedly connected at one of its ends to the handle. A flange depends from the brush portion at one end thereof and extends between a bi-furcated end portion of the handle at which the brush portion is hingedly connected to the handle portion. A pin socket is connected to the distal end portion of the flange and hingedly receives a hinge pin connected across the bi-furcated end portion of the handle so that bristles extending from the brush portion can be moved from an open position through the elongated opening into the hollow interior of the handle for storage purposes. When the brush portion is disposed in a common plane with the handle portion for using the hair brush, the bi-furcated end portion provides great lateral stability for the unit. Detents are provided to maintain the hair brush in its open position, and another set of detents are used to maintain the hair brush in its closed or storage position.

10 Claims, 8 Drawing Figures

FOLDABLE HAIR BRUSH

The present invention relates to a foldable hair brush, and it more particularly relates to a hair brush which is small in size and able to be folded into a small unit for convenient carrying purposes.

Folding brushes have been known in the prior art, and in this regard, brushes have been known to have handles which fold relative to the brush portion thereof. For example, reference may be made to the following U.S. Pat. Nos. 129,564; 1,592,510; 1,626,310; 2,678,459 and 3,091,248. While the brushes disclosed in the foregoing-mentioned patents may be useful for some applications, it would be highly desirable to have a brush which could be conveniently folded into a small package for carrying purposes and which has great lateral stability when disposed in its open or use position. In this regard, the devices shown in the foregoing-mentioned patents suffer from the disadvantage that when they are disposed in their open position with the handle portion disposed in a common plane with the brush portion, they do not have good lateral stability between the two portions of the foldable brush. As a result, when the brush is held in its open position and held by its handle, during use, the joint between the handle portion and the brush portion is subjected to lateral forces which adversely affect the joint or hinge between the handle portion and the brush portion. Moreover, the foldable brush when in its opened position, does not have great lateral stability and thus the foldable brushes of the prior art did not perform satisfactorily for many applications. For example, hair brushes used for toupees and wigs are oftentimes provided with metal bristles to enable the hair piece to be brushed or combed satisfactorily. With such a hair brush, it is highly desirable to have one which can be conveniently folded into a small unit, but it must possess great lateral stability between the two portions thereof during use as a result of the lateral forces exerted on the brush portion during use. Therefore, it would be highly desirable to have a foldable hair brush, which possesses great lateral stability when disposed in its open position. Also, it should be convenient to use and to move between its closed and its open position. Also, such a foldable hair brush should be relatively inexpensive to manufacture. Furthermore, the foldable hair brush should be able to be used as a brush for toupees and wigs.

Therefore, the principal object of the present invention is to provide a new and improved foldable hair brush, which has great lateral stability between its handle portion and its bristle portion, and which is convenient to use and readily movable between its closed and its open position.

Another object of the present invention is to provide such a new and improved foldable hair brush, which can be inexpensively manufactured in large quantities and which can be used for brushing toupees and wigs.

Briefly, the above and further objects are realized in accordance with the present invention by providing a hair brush which includes a hollow elongated handle having an elongated opening therein and a brush portion hingedly connected at one of its ends to the handle. A flange depends from the brush portion at one end thereof at a bi-furcated end portion of the handle, and a pin socket is connected to the distal end portion of the flange for hingedly receiving a hinge pin connected across the bi-furcated end portion of the handle to connect hingedly the end of the brush portion and the handle at its bi-furcated end portion. As a result, the brush can be moved to its open position to enable the bristles of the bristle portion of the brush to be moved through the elongated opening into the hollow interior of the handle for storage purposes. The bi-furcated end portion provides great lateral stability between the handle portion and the brush portion. Detents are provided to retain the brush in its folded closed position, and also to retain it when it is in its open position.

The invention, both as to its organization and method of operation, together with further objects and advantages thereof will best be understood by reference to the following detailed description taken in connection with the accompanying sheet of drawings, wherein.

Figures 1, 2, 3, 4, 5, 6, 7, 8:
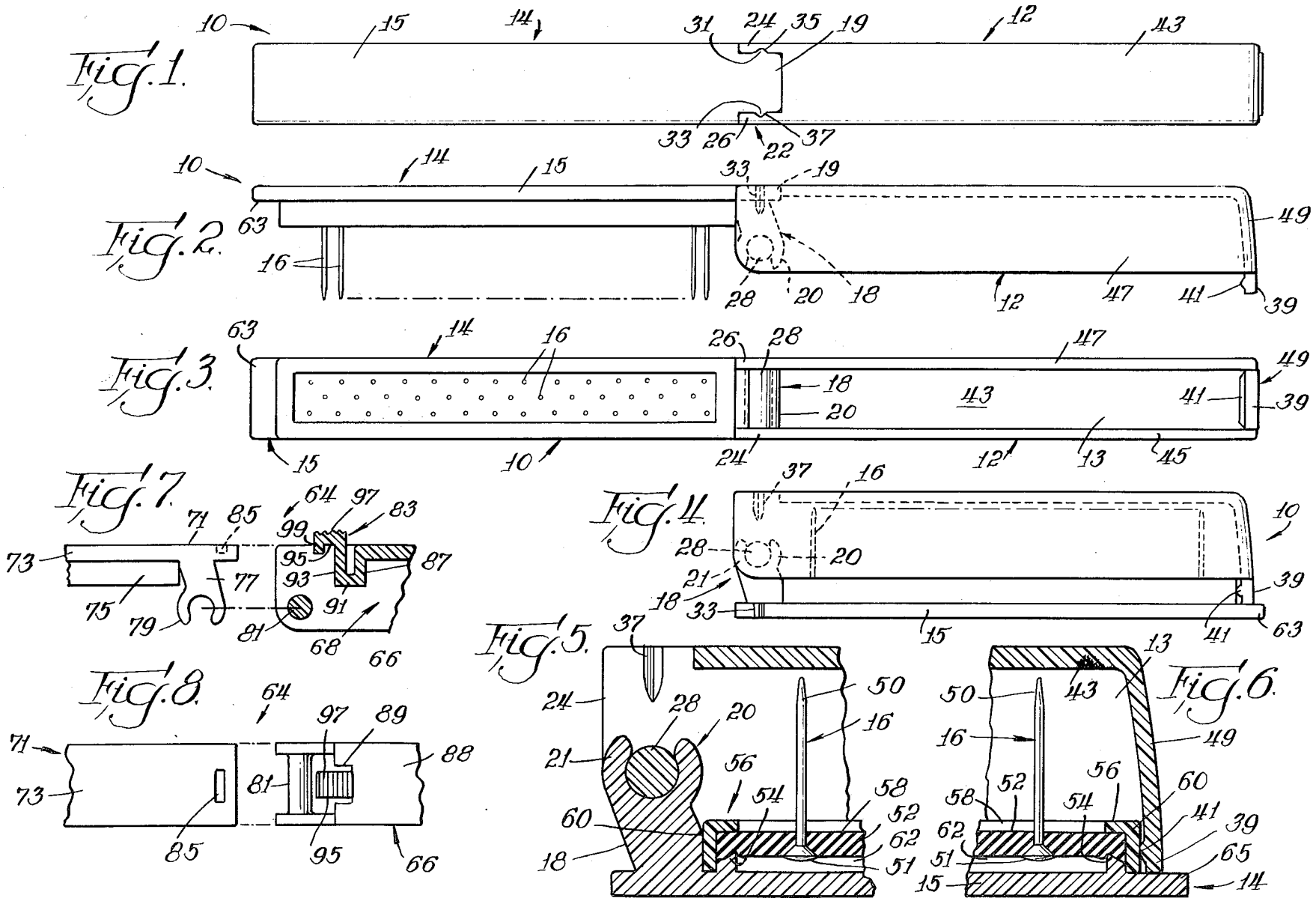
FIG. 1 is a top plan view of a foldable brush, which is constructed in accordance with the present invention and which is shown in its open or use position.
FIG. 2 is an elevational view of the brush of FIG. 1.
FIG. 3 is a bottom plan view of the brush of FIG. 1.
FIG. 4 is a side elevational view of the brush of FIG. 1 illustrating it in its closed or storage position.
FIG. 5 is a greatly enlarged, fragmentary cross-sectional view of the hinge portion of the brush of FIG. 4.
FIG. 6 is a greatly enlarged, fragmentary cross-sectional view of the rear portion of the brush of FIG. 4.
FIG. 7 is a detached fragmentary cross-sectional view of the hinge portion of another foldable brush constructed in accordance with the present invention, the view being a side elevational view.
FIG. 8 is a detached top plan view of the brush of FIG. 7.

Referring now to the drawings, and more particularly to FIGS. 1, 2, 3, 4 and 5 of the drawings, there is shown a foldable hair brush 10, which is constructed in accordance with the present invention. The foldable hair brush 10 generally comprises a hollow elongated handle 12 having a compartment 13 disposed therein, and a brush portion 14 hingedly connected to the handle 12. As shown in FIGS. 1, 2 and 3 of the drawings, the handle 12 and the brush portion 14 are disposed generally in a common plane when the brush 10 is disposed in its open or use position. As shown in FIGS. 4 and 5 of the drawings, the brush portion 14 is at least partially disposed within the compartment 13 of the handle 12 when the brush 10 is folded into its closed or storage position. Thus, the folded brush 10 is a compact unit which may be carried very conveniently.

The brush portion 14 includes a rectangular backing plate 15 having a series of bristle pins or spikes 16 depending therefrom. The rigid bristle pins 16 are primarily intended to be used with toupees or wigs, but it is to be understood that the brush of the present invention may also be used in connection with flexible bristles, such as nylon bristles, for brushing living hair.

A flange 18 depends from a tongue 19 extending from one end portion of the backing plate 15, and a hinge socket 20 is formed on the end of the flange 18 in the form of a C-shaped member 21. A bi-furcated end portion 22 of the handle 12 receives the tongue 19 and includes a pair of parallel spaced-apart flanges 24 and 26 which have a hinge pin 28 fixed to and extending therebetween. The C-shaped member 21 hingedly receives the hinge pin 28 to connect hingedly the brush portion 14 to the handle 12. A pair of detents or ribs 31 and 33 on opposite sides of the tongue 19 are adapted to be received in a pair of respective grooves or ridges 35 and 37 formed in the respective flanges 26 and 24. A flange 39 extends from the opposite end of the handle 12 and has a detent 41 which engages a portion of the brush 14 to hold the brush 10 in its closed position as shown in FIG. 5 of the drawings. The detents 31 and 33 hold releasably the brush 10 in its open position as shown in FIGS. 1, 2 and 3 of the drawings.

Considering now the handle 12 in greater detail, the handle 12 includes a back wall 43 having a pair of parallel spaced-apart side walls 45 and 47 depending therefrom, and an end wall 49 completes the compartment 13 with the opposite bi-furcated end portion 22 being open.

As best seen in FIG. 2 of the drawings, the flange 39 is an extension of the end wall 49, and it extends beyond the plane of the opening to the compartment 13. The detent 41 is in the form of a bead or projection formed on the flange 39 and facing toward the bi-furcated end portion 22.

Considering now the brush portion 14 in greater detail, each one of the pins or spikes 16, as best seen in FIG. 5 of the drawings, includes a rod 50 having a gently rounded pointed end portion and having at the opposite end portion thereof a rounded head 51. A flexible sheet 52 composed of suitable material, such as rubber or the like, has the pin 16 extending therethrough with the head disposed within depressed portion of the surface of the flexible sheet 52. A rectangularly shaped ridge or projection 54 on the backing plate 15 receives the peripheral portion of the rectangular flexible sheet 52, and a bezel 56 fits over and surrounds the projection 54 to clamp the flexible sheet 52 between the bezel 56 and the projection 54. A rectangular opening 58 in the bezel 56 permits the rod portions of the pins 16 to extend therethrough. A skirt portion 60 of the bezel 56 surrounds and engages the projection 54. It should be noted that the outer edge of the projection 54 is pointed to engage the soft flexible sheet 52 for engaging grippingly the flexible sheet 52.

A clearance space 62 between the flexible sheet 52 and the backing plate 15 enables the sheet 52 to deform under use to provide a certain free floating action which is highly desirable when brushing hair.

When the brush 10 is disposed in its open or use position as shown in FIGS. 1, 2 and 3 of the drawings, the handle 12 and the brush portion 14 are disposed in substantially a common plane, and in this regard, the back wall 43 of the handle 12 and the backing plate 15 of the brush portion 14 are substantially coplanar and the outer surfaces thereof are flush with one another. In order to provide for lateral stability of the brush portion 14 relative to the handle 12, the tongue 19 is securely held in place between the flanges 24 and 26 of the bi-furcated end portion 22 of the handle 12. Also, in order to facilitate the lateral stability of the brush 10, the detents or ribs 31 and 33 fit into the respective grooves or ridges 35 and 37 when the brush 10 is disposed in its open position.

The flange 18 extends across the tongue 19 between the flanges 24 and 26 of the handle 12. The flange 18 terminates in the C-shaped member 21 below the tongue 19 to engage hingedly the pin 28. The C-shaped member 21 opens directly away from the backing plate 15 to facilitate assembly of the brush 10. In this regard, the C-shaped member 21 is snapped into engagement with the hinge pin 28 to complete the assembly of the brush 10.

In order to swing the brush portion 14 from the open position as shown in FIGS. 1, 2 and 3 to the closed position of the brush 10, as shown in FIGS. 4 5 and 6 of the drawings, the handle 12 and the brush portion 14 are grasped by the hands of the users and the brush portion 14 is moved pivotally about the hinge pin 28 in a counter-clockwise direction as viewed in FIG. 2 of the drawings until the pins or spikes 16 enter the compartment 13 of the handle 12.

It should be understood that in accordance with the present invention, the hinge pin 28 is disposed in an offset manner relative to the backing plate 15, and the hinge pin 28 is disposed near the mouth portion opening into the compartment 13. In this regard, the hinge pin 28 is disposed out of the plane of the backing plate 15 and the back wall 43 to increase still further the lateral stability of the brush portion 14 relative to the handle 12. In this regard, if the hinge pin were disposed in the same plane as the backing plate 15 and the back wall 43, the brush portion 14 could move slightly in a lateral direction relative to the handle 12. Whereas, with the offset position of the hinge pin 28 in accordance with the present invention, the flanges 24 and 26 prevent movement of the tongue 19 which is an integral portion of the backing plate 15, the detents or ribs 31 and 33 also serving to prevent movement of the tongue 19 relative to the handle 12.

After the brush 10 has been folded into a closed position as shown in FIGS. 4 5 and 6 of the drawings, the detent 41 disposed on the flange 39 engages the end portion of the bezel 56 to fix releasably the brush 10 in its closed position. An extension 63 of the backing plate 15 extends outwardly beyond the flange 39 to serve as a finger grip to unlatch the detent 41 to permit the brush portion 14 to be swung in a clockwise direction as viewed in FIGS. 4 and 5 of the drawings back to its open position as shown in FIGS. 1, 2 and 3 of the drawings.

The entire brush 10 may be composed of plastic material, except for the pins 16 and the flexible sheet 52. In this regard, the bezel 56 may be fixed to the backing plate 15 by any suitable technique such as heat welding, ultrasonic welding or suitable adhesives. The pin 16 may be composed of metal or plastic materials, and the flexible sheet 52 may be composed of other materials than rubber, such materials including plastic materials.

Referring now to FIGS. 7 and 8 of the drawings, there is shown another foldable hair brush 64, which is constructed in accordance with the present invention and which is similar to the hair brush 10 except that it includes a different form of latching detent to hold the brush 64 in its open position. The brush 64 generally comprises a handle 66 which is similar to the handle 12 and which has an elongated compartment 68 similar to the compartment 13. The brush 64 includes a brush portion 71 which is similar to the brush portion 14 of the brush 10. The brush portion 41 includes a backing plate 73 having bristle pins or spikes 75 extending therefrom in a similar manner as the pins or spikes 16 extend from the backing plate 15 of the brush 10, and in this regard, the pins or spikes 75 are held in position in the same manner as the corcesponding pins or spikes are held in position in the brush 10. A flange 77 depends from the backing plate 73 and terminates in a C-shaped hinge socket 78 which receives hingedly a hinge pin 81 for connecting hingedly the handle 66 and the brush portion 71 in a manner similar to the manner in which the brush portion 14 is hingedly connected to the handle 12 of the brush 10.

In accorance with the present invention, a latching member 83 is integrally formed on the handle 66 and is adapted to fit into a notch or opening 85 in the outer surface of the backing plate 73 to secure releasably the brush 64 in its open position. The latching member 83 has a depending portion 87 which extends from and is integrally connected to the back wall 88 of the handle 66 within a cut-out opening 89 in the back wall 88.

A connecting portion 91 integrally connects the depending portion 87 and an upstanding portion 93. A lateral portion 95 having an upper serrated surface 97 integrally connects the upstanding portion 93 with a short depending distal end portion 99. In this regard, the short depending distal end portion 99 snaps into engagement with the opening 85 when the brush 64 is moved into its open position in a manner similar to the manner in which the brush 10 is snapped into its opened position as previously described herein. In order to release the latching member 83 to permit the brush portion 71 to swing about the hinge pin 81 until it is moved into a closed position, the fingers or thumb of the user can grasp the serrated surface 97 of the lateral portion 95 to back the distal end portion 99 out of the opening 85 by pulling backwardly on the latching member 83 which then deforms slightly to enable it to bend backwardly. After the pressure is released on the serrated portion 97, the latching member 83 springs back to its original position as shown in FIG. 7 of the drawings.

While the present invention has been described in connection with particular embodiments thereof, it will be understood that those skilled in the art may make many changes and modifications without departing from the invention. For example, many different types and kinds of materials may be employed in the foldable hair brush of the present invention. Accordingly, it is intended by the appended claims to cover all such changes and modifications as fall within the true spirit and scope of this invention.

What is claimed is:

1. A hair brush comprising:

a hollow elongated handle portion having an elongated opening therein;

a brush portion hingedly connected to said handle;

bristle means extending from said brush portion;

one of said portions having radially inwardly extending flange means and the other one of said portions having a bi-furcated end for receiving said flange means;

a pin socket connected to one of said bi-furcated ends and said flange means;

hinge pin means connected at the other one of said bi-furcated ends and the distal end of said flange means for engaging hingedly said socket to connect said brush portion to said handle portion so that the brush can be moved to its closed position to enable said bristle means to be moved through said elongated opening into the hollow interior of said handle portion for storage purposes; and a pair of oppositely disposed open position detent members on the side faces of one of said bi-furcated ends and said flange means spaced outwardly from said pin means by a substantial distance projecting in a direction parallel to the axis of said hinge pin and means defining a pair of grooves at the other one of said bi-furcated ends and said flange means for receiving releasably said detent members to hold releasably said brush in its open position with said brush portion and said handle portion in a substantially coplanar relationship.

2. A hair brush according to claim 1, wherein said pin socket is a C-shaped member integrally connected to the distal end portion of said flange.

3. A hair brush according to claim 1, wherein said brush portion includes a base plate having a tongue portion extending from the end portion thereof, said handle portion being open at its bi-furcated end facing said base plate for receiving said tongue portion, said bi-furcated end portion being a pair of parallel spaced-apart flanges, said hinge pin connected at its opposite ends to said legs.

4. A hair brush according to claim 1, further including close position detent means for holding releasably said brush portion with its bristles extending into the interior of said hollow handle.

5. A hair brush according to claim 1, wherein said brush portion includes a base plate, and a flexible sheet carrying said bristle means extending therefrom attached to said base plate.

6. A hair brush according to claim 1, further including a latching member on said handle portion for engaging an opening in said brush portion.

7. A hair brush according to claim 3, said tongue and said flanges include said open position detent members and said groove means for receiving said detent members to hold releasably said brush in its open position with said base plate and said handle in a substantially coplanar relationship.

8. A hair brush according to claim 6, wherein said latching member includes a depending portion, a connecting portion connected to said depending portion, an upstanding portion connected to said connecting portion, a lateral portion connected to said upstanding portion, and a depending distal end portion connected to said lateral portion.

9. A hair brush comprising:

a hollow elongated handle having an elongated opening therein and having a bi-furcated end portion;

a brush portion hingedly connected at one of its ends to said handle;

bristle means extending from said brush portion;

a flange depending from said brush portion at one end portion thereof at said bi-furcated end portion of said handle;

a pin socket connected to the distal end portion of said flange; and a hinge pin connected across said bi-furcated end portion of said handle for engaging hingedly said socket to connect said one of the ends of said brush portion to said handle at its bi-furcated end portion so that the brush can be moved to its closed position to enable said bristle means to be moved through said elongated opening into the hollow interior of said handle for storage purposes;

wherein said brush portion includes a bezel having an opening therein for fitting over said bristle means to secure said flexible sheet in place, ridge means projecting from said base plate, said bezel having a skirt portion depending therefrom to surround and to engage tightly said ridge means.

10. A hair brush according to claim 9, wherein said ridge means is pointed at its distal end portion to engage snugly said flexible sheet.

* * * * *